US005762207A

United States Patent [19]

Maglione

[11] Patent Number: 5,762,207

[45] Date of Patent: Jun. 9, 1998

[54] COLLAPSIBLE PEG TYPE DISPLAY STAND

[76] Inventor: Stephen Thomas Maglione, 15 Ava Maria Ct., Millington, N.J. 07946

[21] Appl. No.: 543,656

[22] Filed: Jan. 17, 1996

[51] Int. Cl.[6] ..... A47F 5/00

[52] U.S. Cl. ..... 211/59.1

[58] Field of Search ..... 211/59.1, 195, 211/73, 189; 248/174, 459

[56] References Cited

U.S. PATENT DOCUMENTS

| | | | |
|---|---|---|---|
| 1,497,456 | 6/1924 | List | 248/174 X |
| 1,886,532 | 11/1932 | Davidson . | |
| 1,902,566 | 3/1933 | Marsh . | |
| 3,341,162 | 9/1967 | Ruchlis . | |
| 3,433,365 | 3/1969 | Hodson . | |
| 3,494,479 | 2/1970 | Martin . | |
| 3,871,608 | 3/1975 | Ogden . | |
| 4,311,233 | 1/1982 | Austin . | |
| 4,550,839 | 11/1985 | Good . | |
| 4,671,417 | 6/1987 | O'Brien . | |
| 4,687,128 | 8/1987 | White . | |
| 4,733,782 | 3/1988 | Spezial et al. . | |
| 4,813,536 | 3/1989 | Willis . | |
| 4,860,905 | 8/1989 | Schott et al. . | |
| 4,949,851 | 8/1990 | Shaffer . | |
| 5,273,169 | 12/1993 | Maglione . | |
| 5,277,388 | 1/1994 | Denaro . | |
| 5,305,875 | 4/1994 | Meyer . | |
| 5,465,851 | 11/1995 | Smith . | |
| 5,522,574 | 6/1996 | Maglione | 248/174 |

*Primary Examiner*—Alvin C. Chin-Shue
*Assistant Examiner*—Sarah L. Purol

[57] ABSTRACT

A corrugated paperboard header display panel comprising a single folded over sheet has discrete peg receiving apertures in a front sheet and slots in a rear sheet aligned with the apertures. The panel is supported by a pair of triangular supports of a folded over paper board sheet formed as a one piece corrugated support and brace structure. The supports are interlocked to the display panel with aligned slots. The supports have an inclined upper edge that terminates at the support edge in the front region and at an upper point of a vertical rear edge. A brace is hinged to and between the supports at a fold line at the support vertical rear edge. A flap is hinged to the brace at a fold line and has a pair of tabs extending therefrom hinged at a further fold line. The display panel rear sheet has a member hinged thereto which forms a tab receiving slot for securing the flap to the header panel. The header panel folds medially forming a first collapsed section and the support and brace structure is foldable with the supports folded over the brace and flap to form a second collapsed section. The two folded collapsed sections overlie to form a compact package.

22 Claims, 7 Drawing Sheets

FIG. 1
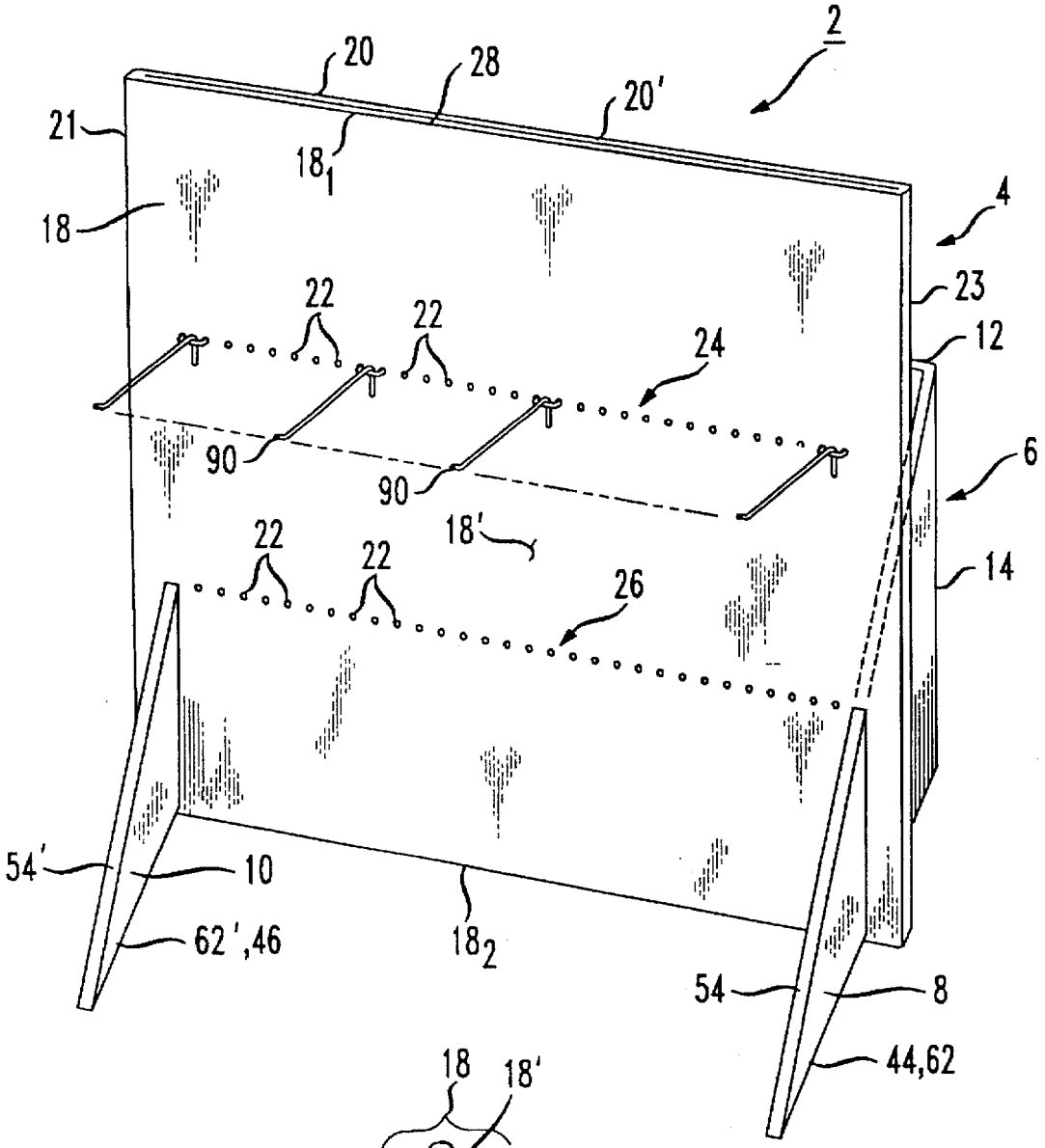
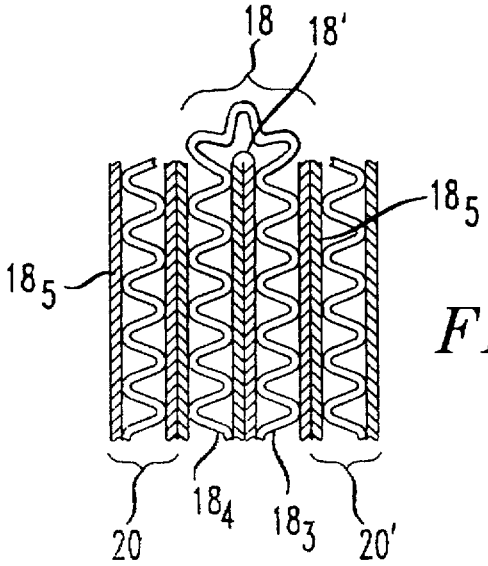
FIG. 1a

FIG. 12
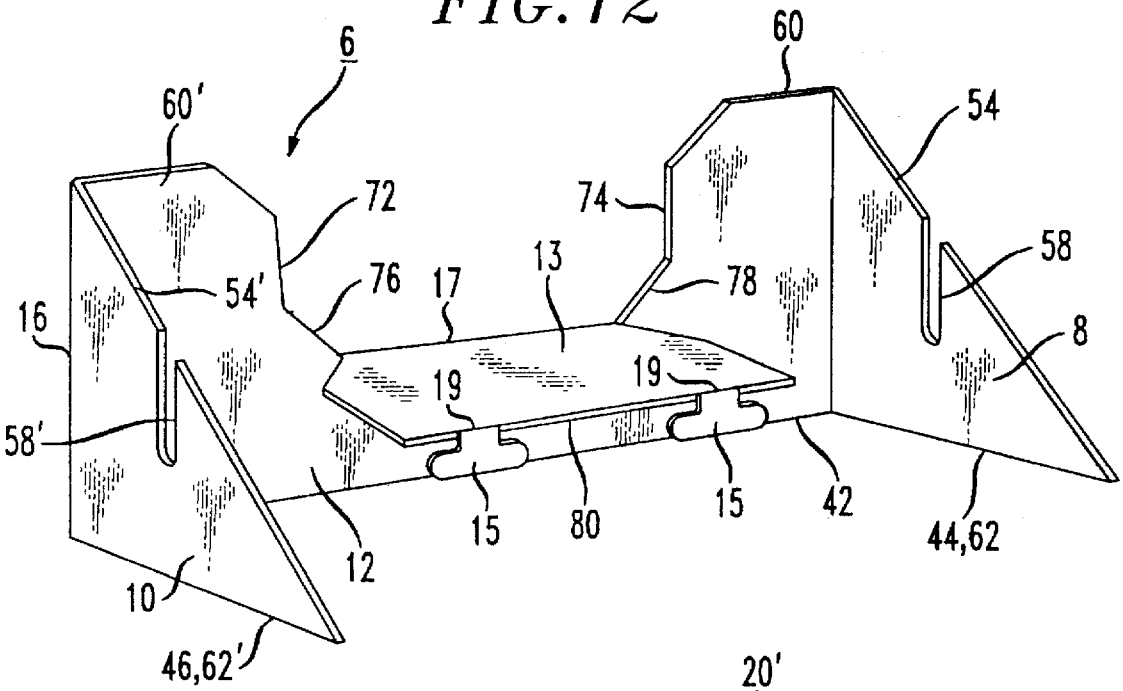
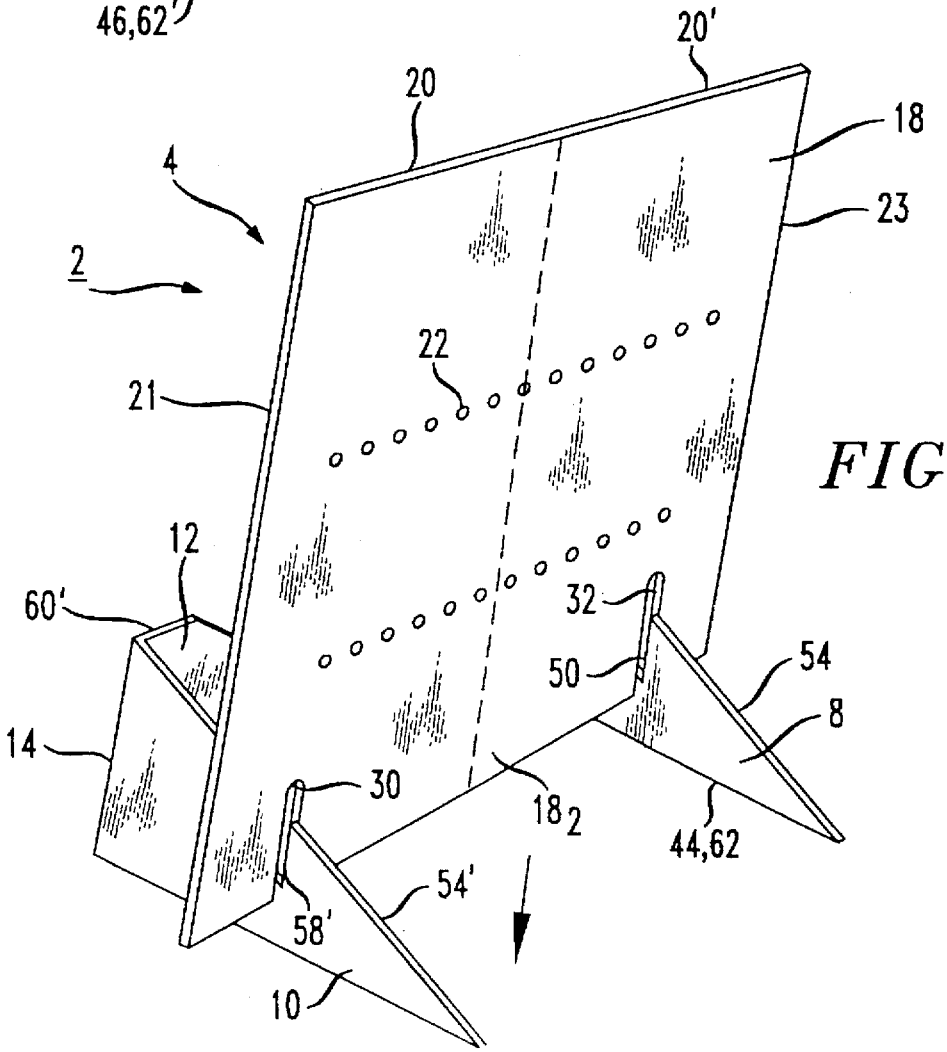
FIG. 13

COLLAPSIBLE PEG TYPE DISPLAY STAND

This invention relates to collapsible display stands, and more particularly, to peg type paperboard stands.

Of interest are copending applications of the present inventor Ser. No. 291,129 entitled Collapsible Display Stand filed Aug. 14, 1994 and Ser. No. 394,466 filed Feb. 27, 1995 entitled Collapsible Peg Display Stand.

Peg type displays are in wide use. See for example, U.S. Pat. Nos. 3,871,608; 4,724,967; 4,733,782; 4,550,839 and 4,671,417 by way of example. Collapsible stands are also known. See for example U.S. Pat. Nos. 5,277,388; 4,949,851; 5,213,220 and 4,550,839. These types of displays are typically designed for specific display purposes. Stands may be fabricated of multiple pieces and or from a single sheet of paperboard. See U.S. Pat. No. 5,277,388 and the above-noted copending application filed Aug. 16, 1994 for a stand comprising a single sheet of paperboard, for example. See others of the above patents and the copending application filed Feb. 27, 1995 for multiple piece stands.

Some are relatively complex. See for example U.S. Pat. No. 5,213,220 and others relatively simple such as U.S. Pat. No. 3,871,608. The present inventor recognizes a need for a simple display stand that is readily adapted for counter display and is attractive in appearance.

A collapsible peg board display stand including a peg receiving header panel and a support structure for the panel for displaying articles on at least one peg secured to the header panel according to the present invention comprises a header display panel having a plurality of article display peg receiving openings therethrough and front and rear sides. First and second supports are releasably interlocked to the display panel in spaced relation to each other and extend beyond at least the rear side. A first edge of each support supports the stand. A transverse brace is secured to and between the supports at the display panel rear side. Further brace means releasably secure the brace to the header panel medially the supports.

In one embodiment, the brace, supports and further brace means are one piece sheet material wherein the first and second supports have a rear edge, the brace being hinged to the rear edge of each support forming a generally U-shaped member.

In a second embodiment, the further brace means comprises a flap member hinged to the brace at a flap member proximal edge, tab means are coupled to the flap member at a flap member edge distal the brace and distal the proximal edge and is coupled to the header panel for releasably securing the flap member to the header panel.

BRIEF DESCRIPTION OF THE DRAWING

FIG. 1 is an isometric view of the stand according to the present invention;

FIG. 1*a* is a fragmented sectional view through the front sheet of the header display panel when folded showing the folded condition of the different layers forming the front sheet;

FIG. 12 is an isometric view of the header panel support and brace structure folded to the state for receiving the header panel;

FIG. 13 is an isometric view of the header panel being assembled to the support and brace structure of FIG. 12;

In FIGS. 1–4, display stand 2 comprises a one piece display header panel 4 and a one piece brace and support structure 6 comprising a pair of identical, preferably triangular, supports 8 and 10, an intermediate brace 12, a flap 13 and a pair of tabs 15 (FIG. 12). The brace 12, FIGS. 10 and 12, is hinged to the supports 8 and 10 at respective fold lines 14 and 16. The flap 13 is hinged to the brace 12 at fold line 17. The tabs 15 are hinged to the flap 13 at respective fold lines 19. The fold lines in the unfolded state of the sheet material are shown by dashed lines, FIGS. 5–6, 9, and 10–11. Through cuts in the blanks sheet material, FIGS. 6 and 10, are represented by solid lines.

The display panel 4 comprises a front sheet 18 and a pair of rear sheets 20 and 20', preferably corrugated sheet paperboard of single ply thickness. The rear sheets 20 and 20' are hinged to the front sheet 18 at respective hinge fold lines 21 and 23. The front sheet 18 has a fold line 18' extending from the top edge $\mathbf{18}_1$ to the bottom edge $\mathbf{18}_2$. As shown in FIG. 1*a*, the panel 4 front sheet 18 comprises a front single ply layer $\mathbf{18}_3$ having the fold line 18'. A undulating single ply layer $\mathbf{18}_4$ is sandwiched between the front layer $\mathbf{18}_3$ and a single ply rear layer $\mathbf{18}_5$ of sheet 18. To permit the panel 4 to fold sharply at fold line 18, the layers $\mathbf{18}_4$ and $\mathbf{18}_5$ are cut at the fold line 18 so that the sheet 18 fold hinge is formed only by layer $\mathbf{18}_3$ which is relatively thin.

Figure 2:
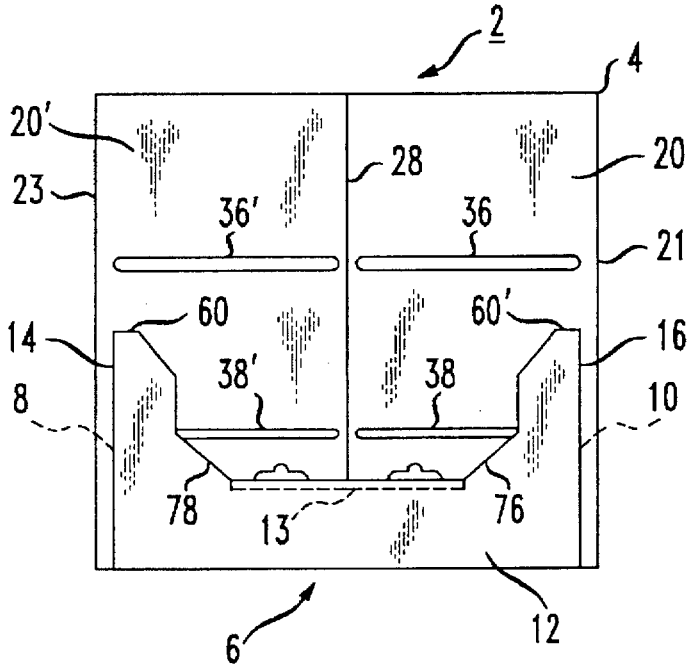
FIG. 2 is a rear elevation view of the stand of FIG. 1.

The support and brace structure 6 is preferably of the same material as the header display panel. Other paperboard, such as stiff single ply non-corrugated sheets or multiple corrugated sheets or multiple ply sheets may also be used in the alternative.

A plurality of discrete separate peg receiving apertures 22 are in the display board 4. The apertures 22 are arranged in two linear arrays 24 and 26. The aperture arrays 24 and 26 are by way of example and other array arrangements may be provided as desired. See for example the aforementioned copending applications incorporated by reference herein. The apertures 22 are circular holes through the front sheet 18.

The rear sheets 20 and 20' when folded over front sheet 18 form a seam 28, FIG. 2. The sheets 20 and 20' are preferably fastened to the front sheet 18 with an adhesive to form panel 4. The edges of the sheets 20 and 20' at seam 28 are not bonded so that when folded over as in FIG. 1*a* the facing edges of sheets 20 and 20' at the seam may separate.

Figure 9:
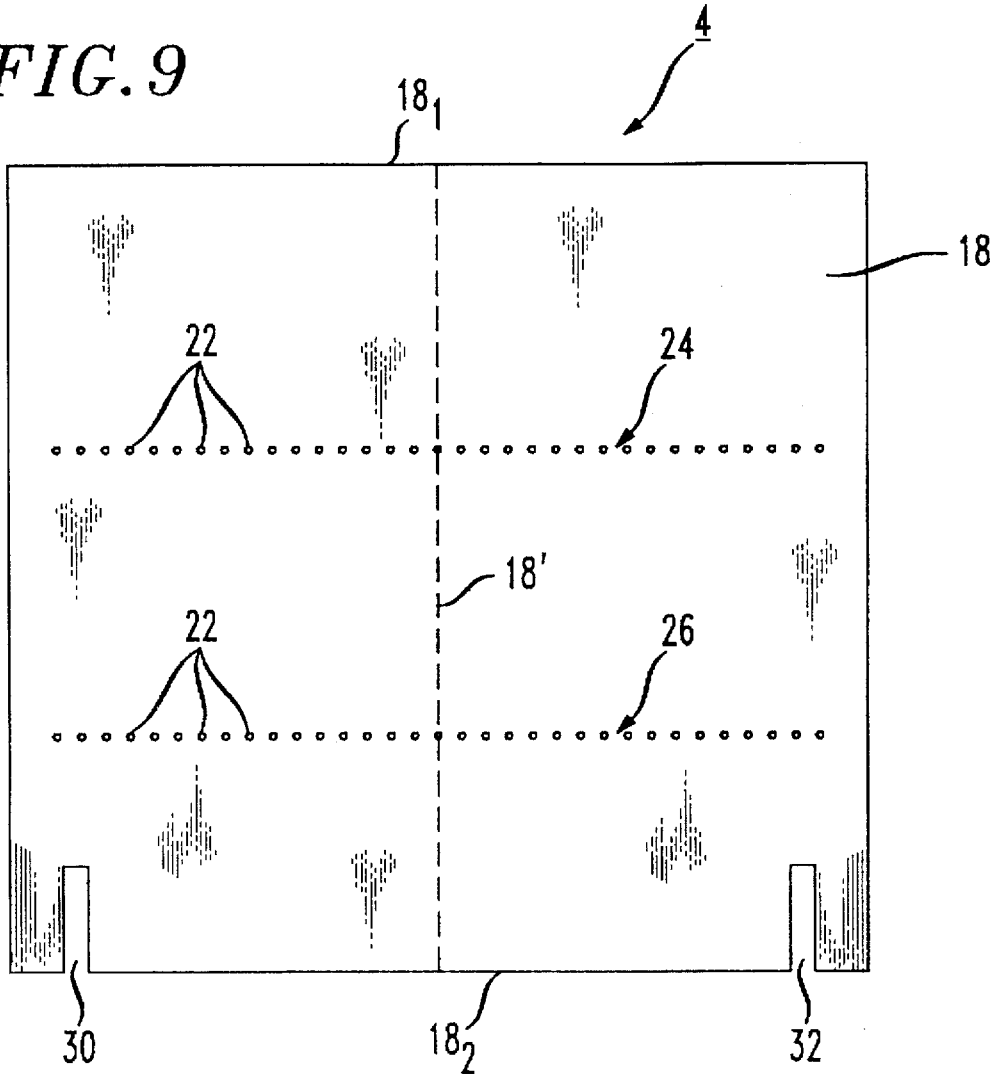

The panel 4 is approximately square, but may be rectangular or other shapes. Vertical slots 30 and 32, FIG. 9, are respectively, in mirror image fashion, in the panel 4 adjacent to each side of the panel 4 in communication with bottom edge $\mathbf{18}_2$.

The rear sheet 20, FIG. 2, has horizontal slots 36 and 38. Slot 36 is aligned with a portion of the linear array 24 of discrete apertures 22, FIG. 1, on one side of the seam 28. The slot 38 is aligned with the discrete apertures 22 of lower aperture array 26, FIG. 1, on one side of the seam 28.

The rear sheet 20', FIG. 2, is preferably identical to rear sheet 20 and has horizontal slots 36' and 38'. Slot 36' is aligned with a portion of the upper linear array 24 of discrete apertures 22, FIG. 1, on the other side of the seam 28. The slot 38' is aligned with the discrete apertures 22 of the lower aperture array 26, FIG. 1, on the other side of the seam 28. The slots 36, 36', 38, and 38' have a transverse width from the top to bottom of the drawing that is preferably greater than the diameter of the apertures 22, FIG. 16. This allows leeway in registration of the apertures 22 to the slots 36 and 38 and so on when the sheets 20 and 20' are folded over sheet 18. This leeway is needed due to manufacturing tolerances in forming the fold lines, apertures and slots.

Figure 6:
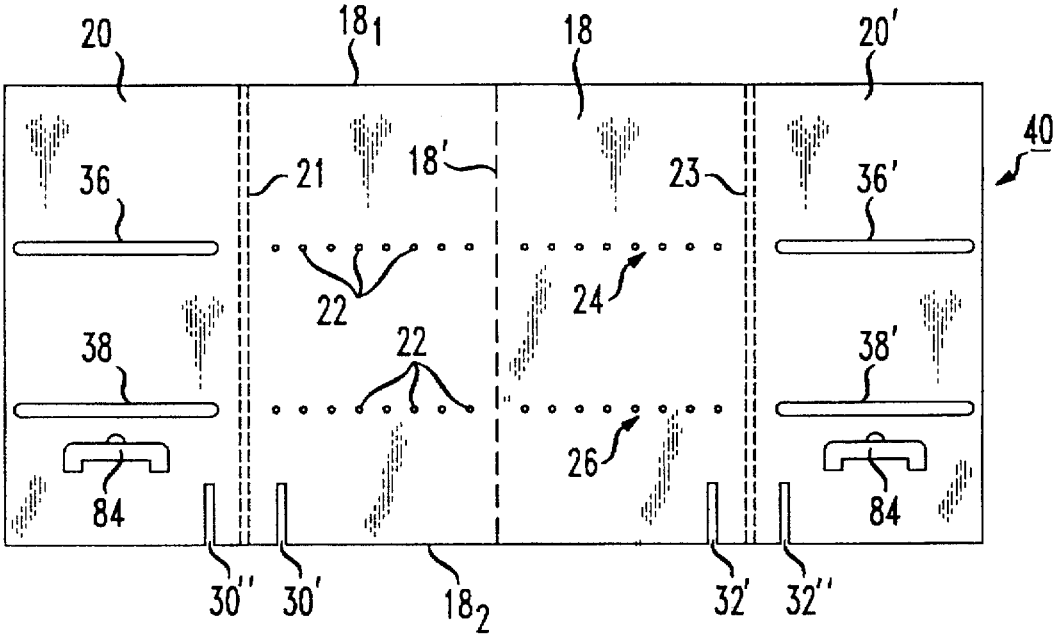
FIG. 6 is an elevation view of the header panel blank prior to folding.

In FIG. 6, the header display panel 4 is formed from a blank 40. In the blank 40, slot 30 is formed by slots 30' and 30" in the respective front sheet 18 rear sheet 20 and slot 32 is formed similarly by slots 32' and 32" in the respective front sheet 18 and rear sheet 20'. Slots 30' and 30" align to form slot 30 and slots 32' and 32" align to form slot 32 when the front and rear sheets overlie one another when folded (FIG. 1) at fold lines 21 and 23.

Figure 10:
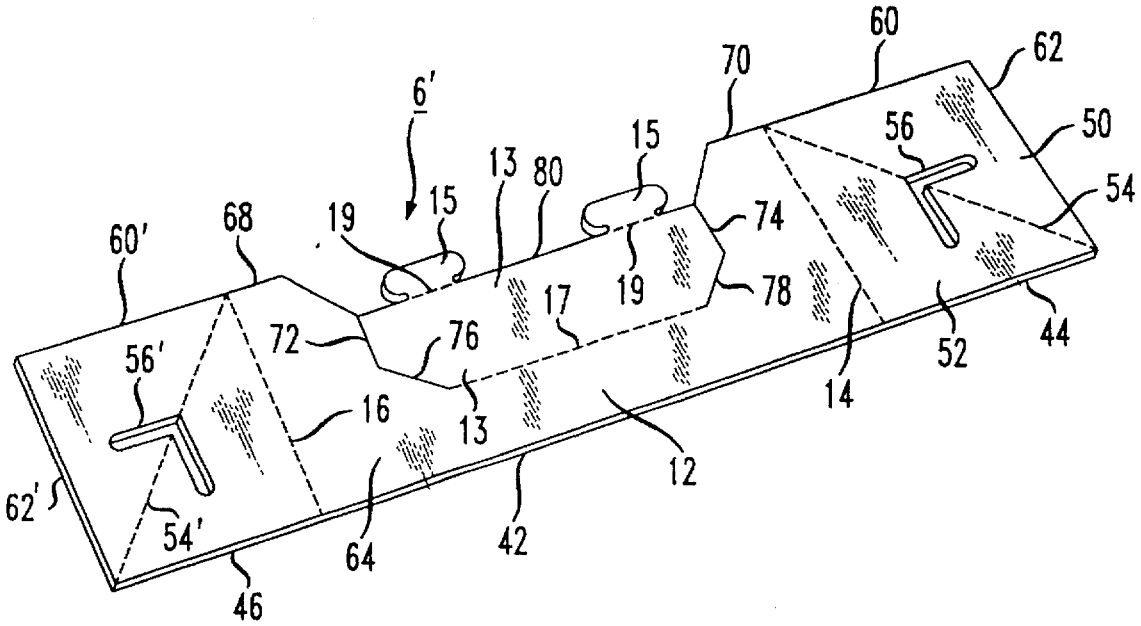
FIGS. 10 AND 11 are respective isometric plan view and isometric partially folded view of the brace structure including header panel supports and the intermediate brace for the supports and header panel.
Figure 11:
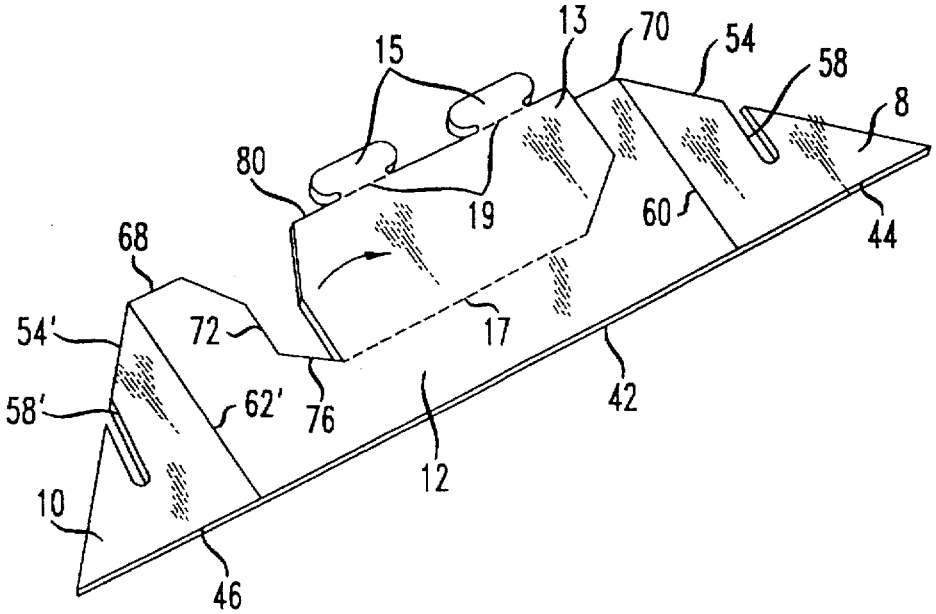

In FIGS. 10, 11 and 12, the support and brace structure 6 brace 12 has lower support edge 42 and the supports 8 and 10 have respective lower support edges 44 and 46, all of which are coplanar and coextensive. The supports 8 and 10 are identical mirror images and only one support 8 will be described as being representative.

The support 8 portion of structure 6 comprises a square in blank form, FIG. 10, formed in a preferably single ply corrugated blank 6' having identical sections 50 and 52. The sections 50 and 52 are separated by a diagonal fold line 54. A right angle slot 56 is formed adjoining sections 50 and 52 with each slot leg of the same length to fold line 54. Section 50 is folded at fold line 54 to form a double thickness triangular support 8, FIG. 11. The legs of the slot 56 overlap to form a combined slot 58. Edge 60 overlies fold line 16 and edge 62 overlies edge 44. The support 10 elements having the identical structures of support 8 have the same reference numeral but primed in FIG. 11. Edges 42, 44 and 46 provide support for the structure 6. Edges 62 and 44 of the sections 50 and 52, respectively, coincide when folded over. Fold line 14 forms a vertical edge for the support 8 at the rear of the support 8.

Brace 12 is formed from the same blank, FIG. 10 as the supports and comprises a single ply sheet corrugated material as do the supports. The brace 12 is formed from a rectangular section which is cut out with material removed in region 66. The brace 12 has upper edges 68 and 70 coupled by an inclined portion which tapers toward each other to a respective transverse edge 72 and 74, respectively. The edges 72 and 74 are coupled to the fold line 17 at opposite fold line ends by a further inclined tapered edge 76 and 78, respectively. The edges 72–78 are solid lines representing cuts in the sheet material. The fold line 17 forms a proximal edge of the flap when in use and is adjacent to the brace 12.

Figure 5:
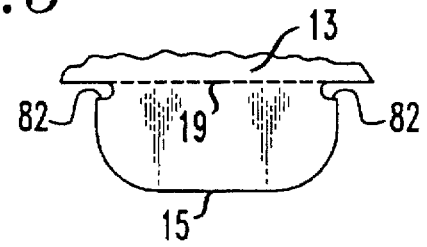
FIG. 5 is a top plan view showing a tab for attaching a flap from the brace to the header panel rear side.

These cuts and the fold line 17 form the flap 13. The flap 13 thus has side edges formed by the brace 12 edges 72, 74, 76 and 78. The tabs 15 extend from distal edge 80 of the flap 13 distal the proximal edge of the flap formed by fold line 17, the edge 80 being offset from the edges 60, 60', 68 and 70, FIG. 10. Typical tab 15 is shown in more detail in FIG. 5. The tab 15 has a locking shoulder 82 on each side as is typical with paper locking tabs in general.

In FIG. 12, the supports 8 and 10 are folded at right angles at respective fold lines 14 and 16 to form a U-shaped member with the brace 12 forming the base of the U and the supports 8 and 10 forming parallel legs of the U. The fold lines 54 and 54' of the supports 8 and 10 respectively are inclined in parallel to merge with the edges 44, 62 and 46, 62. These merge points are at the front portion of the supports in the front region of the header panel 4, FIG. 1. The brace 12 is folded at fold line 17 so that it is horizontal, FIG. 12 and the tabs 15 are folded at fold lines 19 so they are vertical and extend downwardly.

The supports 8 and 10 are assembled concurrently to the display panel 4, FIG. 13, by inserting support 8 slot 58 in panel slot 32 with the plane of the planar support 8 normal to the panel 4 and by inserting slot 58' of support 10 similarly to the slot 30 of the panel 4. The supports 8 and 10 are inserted further until the respective slots receive and fully seat the panel 4, FIG. 1. Thus, the supports are releasably interlocked with the panel 4 by the panel slots and the mating aligned support slots.

Figure 3:
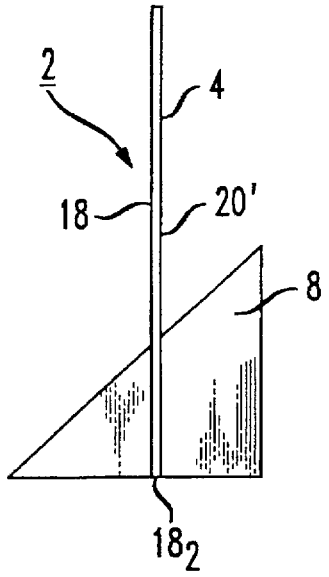
FIG. 3 is a side elevation view of the stand of FIG. 1.
Figure 4:
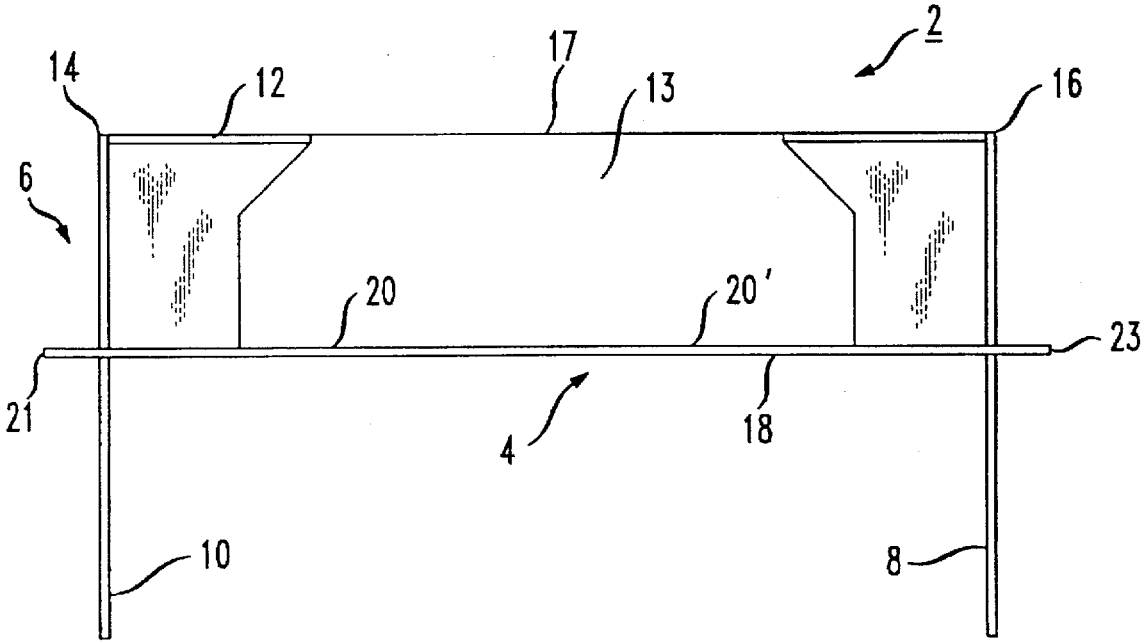
FIG. 4 is a top plan view of the embodiment of FIG. 1.

In FIGS. 1–3, the lower edge $82_2$ of display panel 4 is coplanar with the lower edges 44 and 46 of respective supports 8 and 10 to support the stand on a support surface (not shown).

Figure 7:
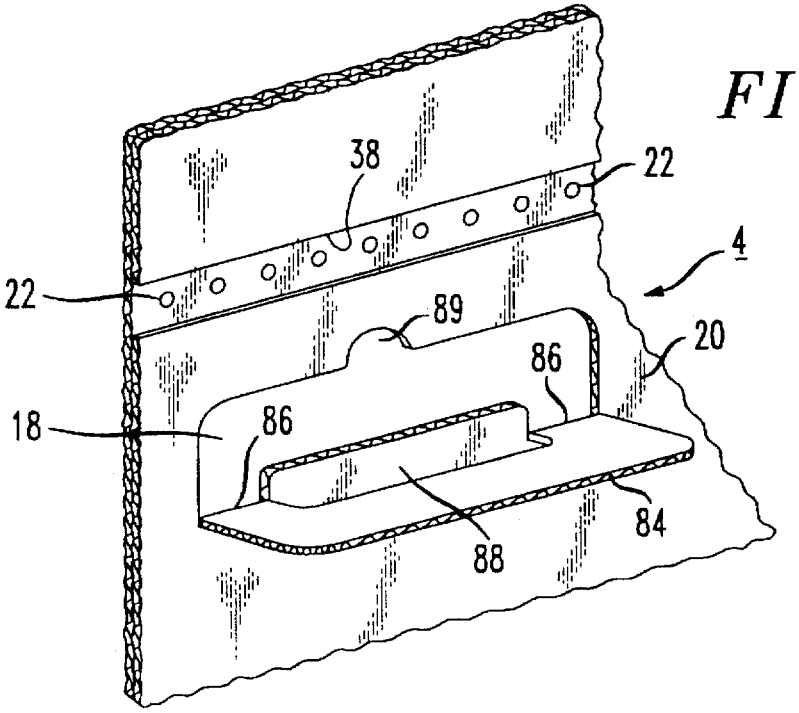
FIG. 7 is an isometric fraagmented view of the rear side of the header panel showing a tab member and slot for receiving the brace tab of FIG. 5.
Figure 8:
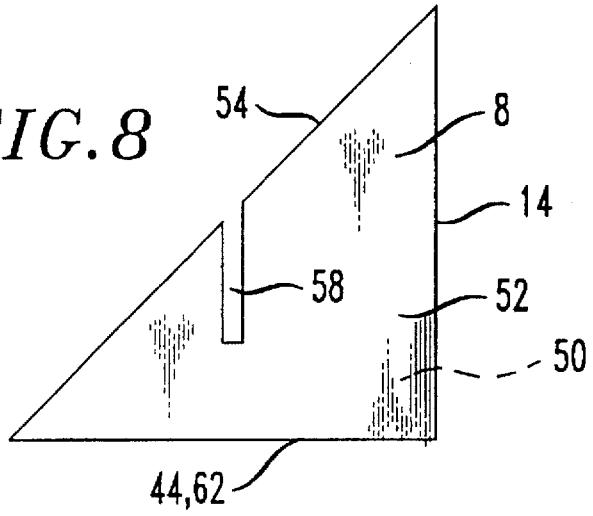
FIGS. 8 and 9 are respective side and front elevation views of a header support and the header display panel.

In FIG. 7, the rear sheet 20 is formed with a U-shaped tab member 84 hinged to the rear sheet 20 at fold lines 86. the tab member 84 forms a slot 88 when the tab member is horizontal relative to the sheet 20 as shown in FIG. 7. A finger slot 90 is formed in the sheet 20 to assist in catching and rotating the tab member 84 from the flat state in the sheet 20.

The rear sheet 20' is formed with a tab member identical to tab member 84. The slots 88 of the tab members on the sheets 20 and 20' receive the tabs 15 of the brace structure 6, FIG. 12.

During assembly of the header display panel to the supports 8 and 10, FIG. 13, the tabs 15, FIG. 12, are inserted into the slots 88 of the corresponding tab members. In this way the flap is secured only to the rear sheets 20 and 20' of the display panel 4. The tabs 15 are thus not visible from the panel 4 front as shown in FIG. 1. Most of the brace 12 is also not visible from the stand front looking toward the rear. The supports 8 and 10, while prominent in the front region, because they are triangular, are attractive and do not detract from the appearance of the stand. The structure 6 is thus mostly hidden behind the panel 4.

The described display stand is easily assembled and disassembled by attaching the supports 8 and 10 to the display panel 4 and the brace member 12 to the panel 4 rear sheets 20 and 20' via flap 13 tabs 15 and tab members 84. The stand is sturdy and yet simple and pleasing in appearance. The display panel and supports 8 and 10 receive appropriate coloring, sales indicia and artwork to finish the appearance.

Figure 15:
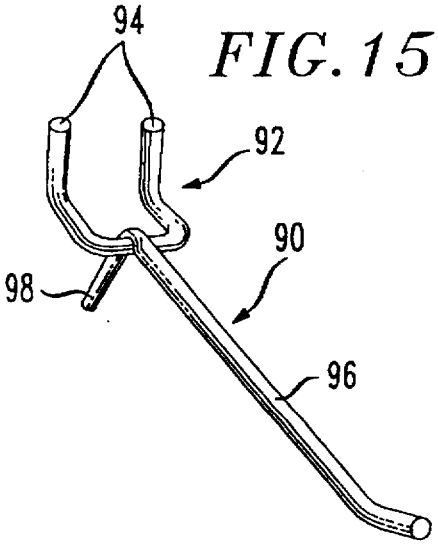
FIG. 15 Is an isometric view of a representative peg of the embodiment of FIG. 1.

In FIG. 15, a representative peg 90 is shown. This is one example and other peg designs may be used. The peg 90 includes a bent U-shaped bracket 92 having legs 94. An article support rod 96 is attached to bracket 102 and has a depending leg 98.

Figure 16:
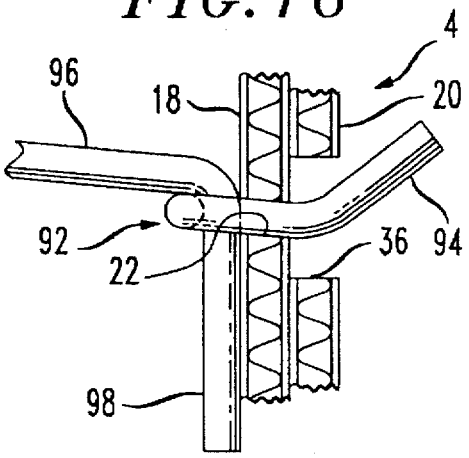
FIG. 16 is a side elevation fragmented sectional view of a peg assembled to the header panel.

In FIG. 16, peg 90 is assembled to a pair of apertures 22 and slot 36, one aperture 22 being shown in this figure. The bracket 92 legs 102 are inserted in selected ones of separate adjacent apertures 22 and extend through the respective aligned slot 36, 36' and 38, 38' of the rear sheets 20 and 20'.

Figure 14:
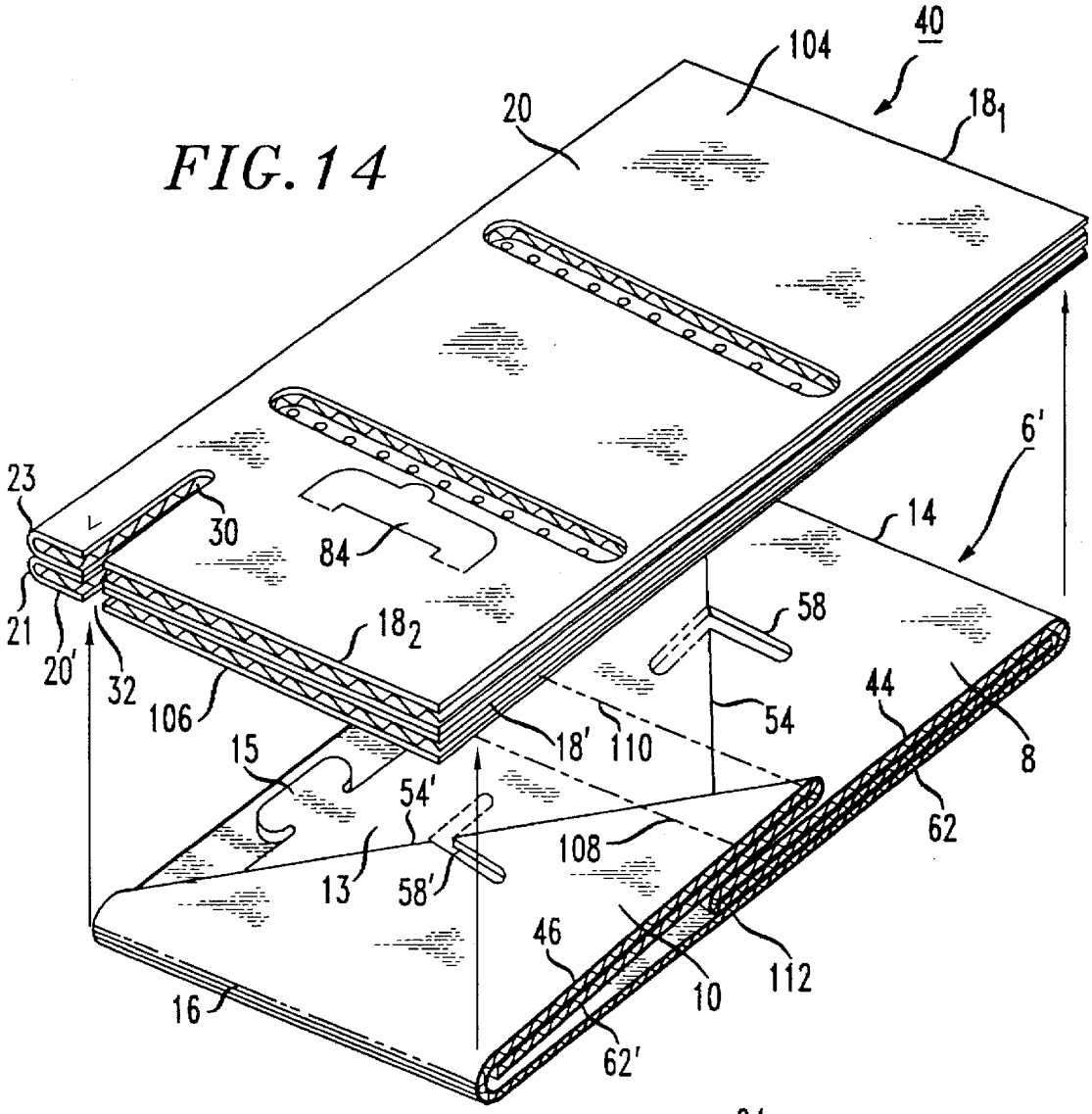
FIG. 14 is an isometric exploded view of the brace and support structure folded aligned with the header panel for packaging the stand in a collapsed state.

In FIG. 14 the header panel 4 blank 40 is folded at the fold line 18' (See FIG. 1*a*) to form two flat relatively thin overlying sections 104 and 106. The support and brace structure 6 blank 6' (FIG. 10) is folded at the fold lines 14 and 16 so that the sections 50 and 52 forming support 8 and sections 50' and 52' forming section 10 overlie one another, the brace 12, the flap 13 and the tabs 15. The phantom lines 108 and 110 show the folded over positions of the blank form of the supports 8 and 10.

As shown in solid line in FIG. 14 the supports 8 and 10 as folded over at their respective fold lines 54 and 58 may also be folded over the brace, flap and tab elements. The supports 8 and 10 in the flat unfolded state of the blank 6' as shown in phantom is preferred as this arrangement is thinner than that shown in solid line. The folded blanks 6' and 40 are then aligned and placed juxtaposed with one another as shown in FIG. 14. This forms the stand as collapsed into a compact package ready for shipment and handling. The pegs may or may not be included in the package as desired.

It will occur to those of ordinary skill that modifications may be made to the disclosed embodiments given by way of illustration and not limitation. For example, slots 36, 36' and 38, 38' are shown with a trasverse width greater than the diameter of the appertures 22. In the alternative, these slots may have a width the same as or less than the diameter of the apertures. By way of further example, these slots may be slits, i.e., cuts in the material. It is intended that the scope of the invention be defined by the appended claims.

What is claimed is:

1. A collapsible display stand for displaying articles on at least one peg secured to the display stand, the stand comprising:

a header display panel having a plurality of article display peg receiving openings therethrough, said panel having a front and a rear side;

first and second supports releasably secured to the panel in spaced relation to each other, the supports extending beyond at least the rear side from the panel, a first edge of each support for supporting the stand;

a transverse brace secured to and between the supports at the header panel rear side; and further brace means for releasably securing the brace to the header panel medially the supports.

2. The stand of claim 1 wherein the brace, supports and further brace means are one piece sheet material wherein the first and second supports have a rear edge transverse the first edge, the brace being hinged to the rear edge of each support forming a generally U-shaped member.

3. The stand of claim 1 wherein the supports are triangular, the supports extending beyond the front side and terminate at an apex with said first edge.

4. The stand of claim 1 wherein the further brace means comprises a flap member hinged to the brace at a flap member proximal edge, tab means coupled to the flap member at a flap member edge distal the brace and distal the proximal edge, said tab means including means coupled to the header display panel for releasably securing the flap member to the header display panel.

5. The stand of claim 4 wherein the tab means comprises a male tab extending from the flap member distal edge and a slot at the header panel rear side for receiving said male tab.

6. The stand of claim 5 wherein said header panel has a U-shaped tab member forming said slot with the panel.

7. The stand of claim 6 wherein the header panel is formed of two overlying sheets bonded to each other, one sheet forming the panel front side and the other forming the panel rear side, said U-shaped tab member being formed in the rear side panel sheet.

8. The stand of claim 1 wherein the header panel has a lower edge with a pair of spaced slots extending into the panel from the lower edge, the supports each having an inclined upper edge and a slot extending into each support from the support upper edge, a support slot being aligned with and engaged with a panel slot for interlocking the panel in a vertical approximately upright orientation.

9. The stand of claim 1 wherein the header panel comprises a folded over sheet of paper board forming a front sheet and a rear sheet overlying the front sheet, the front sheet having a plurality of spaced discrete apertures therethrough, the rear sheet having a slot aligned with said discrete apertures.

10. The stand of claim 2 wherein the further brace means comprises a flap and a tab secured to the flap and formed with said one piece sheet material, said flap and tab being medially said supports at said rear side, said header panel having slot means at said rear side for receiving said tab.

11. The stand of claim 2 wherein the supports each comprise a folded over paperboard sheet forming said one piece sheet material and having a slot through both said folded over sheets, said display panel having a pair of spaced slots therein, each panel and support slot being interlocked at a different support slot.

12. The stand of claim 11 wherein said supports are triangular with the rear edges vertical and an upper edge inclined from said rear edge at a location distal said first edge and intersecting said first edge at an apex on the panel front side.

13. The stand of claim 2 wherein the one piece sheet material is corrugated paperboard, and wherein the further brace means comprises a flap member having a proximal edge, the flap member proximal edge being hinged at a fold line therebetween to the brace, tab means coupled to a flap member edge distal the brace and distal the proximal edge, said tab means being coupled to the header display panel for releasably securing the flap member to the header panel, the supports being triangular, the supports extending beyond the display panel front side and terminate at an apex with said first edge.

14. A paper board collapsible peg display stand comprising:

a paper board display panel having a front side and a rear side and a lower edge and including peg receiving apertures therethrough;

a pair of spaced like paper board supports, each having upper, support and rear edges, each support being interlocked with the display panel adjacent to the panel lower edge and to the support upper edge, said supports each extending beyond said front and rear sides;

a paper board transverse brace secured to each said supports facing said rear side; and a paper board flap secured to the brace intermediate said supports and releasably secured to the display panel.

15. The display stand of claim 14 wherein said supports, brace and flap are one piece with a fold hinge at the junction between the brace and supports and the between the brace and flap.

16. The display stand of claim 14 wherein the flap includes at least one tab extending therefrom, the header panel having at least one slot on said rear side for receiving said at least one tab.

17. The display stand of claim 16 wherein said header panel comprises a front sheet and a rear sheet, said rear sheet having a member hinged thereto, said member forming said header panel slot for receiving said tab.

18. The display stand of claim 14 wherein the display panel and supports are folded over corrugated paper board, the panel having a front sheet with an array of discrete apertures of a given diameter and a rear sheet with an elongated slot aligned with the array of apertures.

19. The display stand of claim 14 wherein the display panel lower edge is coplanar with the support edges.

20. A paper board collapsible peg display stand comprising:

a paper board header display panel comprising a folded over sheet having an array of peg receiving apertures therethrough, said panel having a lower edge and front and rear sheets; and a one piece support and brace member comprising a pair of like folded over paper board supports each releasably secured to the display panel, each support having a stand support edge, said supports extending from a region in front of said panel to a region to the rear of said panel, a brace member secured to and between the supports and a flap secured to the brace member medially the supports and to the panel rear sheet.

21. The stand of claim 20 wherein the flap is hinged to the brace at a fold line and the brace member is hinged to the supports at a corresponding fold line, the brace member including a tab hinged thereto and the panel rear sheet including a slotted member for receiving said tab.

22. The stand of claim 1 wherein the header panel has a fold line centrally the panel for folding the panel into two overlying sections of substantially the same area, said supports, brace and further brace means comprising one piece sheet material arranged such that the supports fold over the brace and over the further brace means and form with the folded panel two overlying sections of a collapsed layered arrangement.

* * * * *